US005647581A

United States Patent [19]

Corle

[11] Patent Number: 5,647,581

[45] Date of Patent: Jul. 15, 1997

[54] PNEUMATIC CYLINDER CLAMPING DEVICE

[75] Inventor: Daryl Richard Corle, Henrico County, Va.

[73] Assignee: Lucent Technologies Inc., Murray Hill, N.J.

[21] Appl. No.: 527,239

[22] Filed: Sep. 12, 1995

[51] Int. Cl.[6] ..... B23Q 3/08

[52] U.S. Cl. ..... 269/32

[58] Field of Search ..... 269/86, 87, 87.1, 269/87.2, 87.3, 91, 92, 93, 94, 32, 20, 25, 27, 24

[56] References Cited

U.S. PATENT DOCUMENTS

| | | | |
|---|---|---|---|
| 2,928,320 | 3/1960 | Stokey | 269/92 |
| 3,565,415 | 2/1971 | Blatt | 269/32 |

FOREIGN PATENT DOCUMENTS

| | | |
|---|---|---|
| 83330 | 5/1982 | Japan . |
| 755495 | 8/1980 | U.S.S.R. . |
| 1021556 | 6/1983 | U.S.S.R. . |
| 1283025 | 1/1987 | U.S.S.R. . |
| 1313626 | 5/1987 | U.S.S.R. . |

*Primary Examiner*—Robert C. Watson
*Assistant Examiner*—Thomas W. Lynch

[57] ABSTRACT

A pneumatic clamping device which is driven by a single cylinder, but which operates with two degrees of motion so that it is completely out of the way after an assembly operation is complete. A housing which defines an aperture through which a shaft passes to connect to the cylinder. The shaft has two diameters along its length, the smaller of which is nearer the piston. This permits the shaft to point away from a vertical axis when it contacts the inner diameter of the aperture in the housing which provides a sliding fit to the larger diameter of the shaft. The shaft which supports a perpendicular clamp, one end of which will apply the clamping force to the workpiece. The other end of the clamp is connected to a guide which is approximately parallel to the shaft. A pin restrains the motion of the guide as the piston moves from the clamped to the unclamped position. Further movement of the piston impresses a second degree of motion upon the clamp, namely, a rotation about the pin and away from the work area.

13 Claims, 2 Drawing Sheets

PNEUMATIC CYLINDER CLAMPING DEVICE

BACKGROUND OF THE INVENTION

1. Field of the Invention

This invention relates to clamping devices, and in particular to a pneumatically operated device which is adapted to assembly operations of printed circuits in which the clamping device has two degrees of motion which provide clear access to a work area when the device is in an unclamped position.

2. Description of Related Art

Assembly operations require the accurate placement and retention of parts relative to one another. Efficient assembly operations also require the rapid movement of these parts into and away from the assembly work area. Clamping tools which retain the parts in a predetermined position can interfere with the rapidity of the assembly operation if: they remain in the way of the next part to be assembled, or if they disturb the predetermined location of the part as it is clamped. In the electronics industry, the parts to be assembled continue to be more densely packed with finer conductors, thinner insulators, and more critical mechanical tolerances. These parts are also more easily damaged. So there are conflicting requirements placed upon clamping devices to increase throughput, work with tighter tolerances, and protect delicate assemblies.

For the assembly of printed wiring boards, which increasingly have multiple layers of conductors interleaved with insulators, component leads are inserted into holes drilled into the printed wiring board or they are surface mounted to pads which are solder and rosin coated. Either way, the predetermined location of the printed wiring board can not be changed as the clamp is applied. Therefore, the clamp must be applied with a linear motion so as not to twist the printed wiring board. However, a clamp with only a single degree of motion is likely to impede the rapid insertion and removal of the printed wiring board from the assembly position.

Accordingly, there is a need in the assembly art for a clamping device which is compact, which retains the accurate placement of the printed wiring board as the clamp is applied, which has two degrees of motion as the clamp is released so that easy access is provided for insertion of the next printed wiring board, and which does not damage delicate electronic structures.

SUMMARY OF THE INVENTION

The present invention relates to a pneumatically operated clamping device which is driven by a single cylinder, but which operates with two degrees of motion so that it is completely out of the way after an assembly operation is complete.

The clamping device rests upon a base which supports a cylinder containing a piston. The cylinder supports a housing which defines an aperture through which a shaft passes to connect to the cylinder. The shaft has two diameters along its length, the smaller of which is nearer the piston. This permits the shaft to point away from a vertical axis when it contacts the inner diameter of the aperture in the housing which provides a sliding fit to the larger diameter of the shaft. A transition section of the shaft is out of the housing when the clamp is open. The shaft supports a perpendicular clamp, one end of which will apply the clamping force to the workpiece. The other end of the clamp is connected to a guide which is approximately parallel to the shaft. A slide is machined along a portion of the guide, and a pin which is secured by the housing restrains the motion of the guide.

As the piston moves from the clamped to the unclamped position, the pin restrains further linear vertical motion of the guide-clamp-shaft combination as the larger diameter of the shaft clears the aperture of the housing. Further movement of the piston impresses a second degree of motion upon the combination above, namely, a rotation about the pin and away from the work area. The amount of this rotational movement is determined by the smaller diameter of the shaft and the size of the aperture in the housing.

The advantage of this arrangement is that a single piston achieves two degrees of motion so that the clamping force is applied linearly to the workpiece, yet the clamp also rotates away from the assembly area in the unclamped position to provide free access for the rapid removal and insertion of workpieces.

These and other features and advantages of the invention will be better understood with consideration of the following detailed description of the preferred embodiments taken in conjunction with the accompanying drawings.

The drawings are not to scale.

DETAILED DESCRIPTION OF THE PEFERRED EMBODIMENTS

Figure 1:
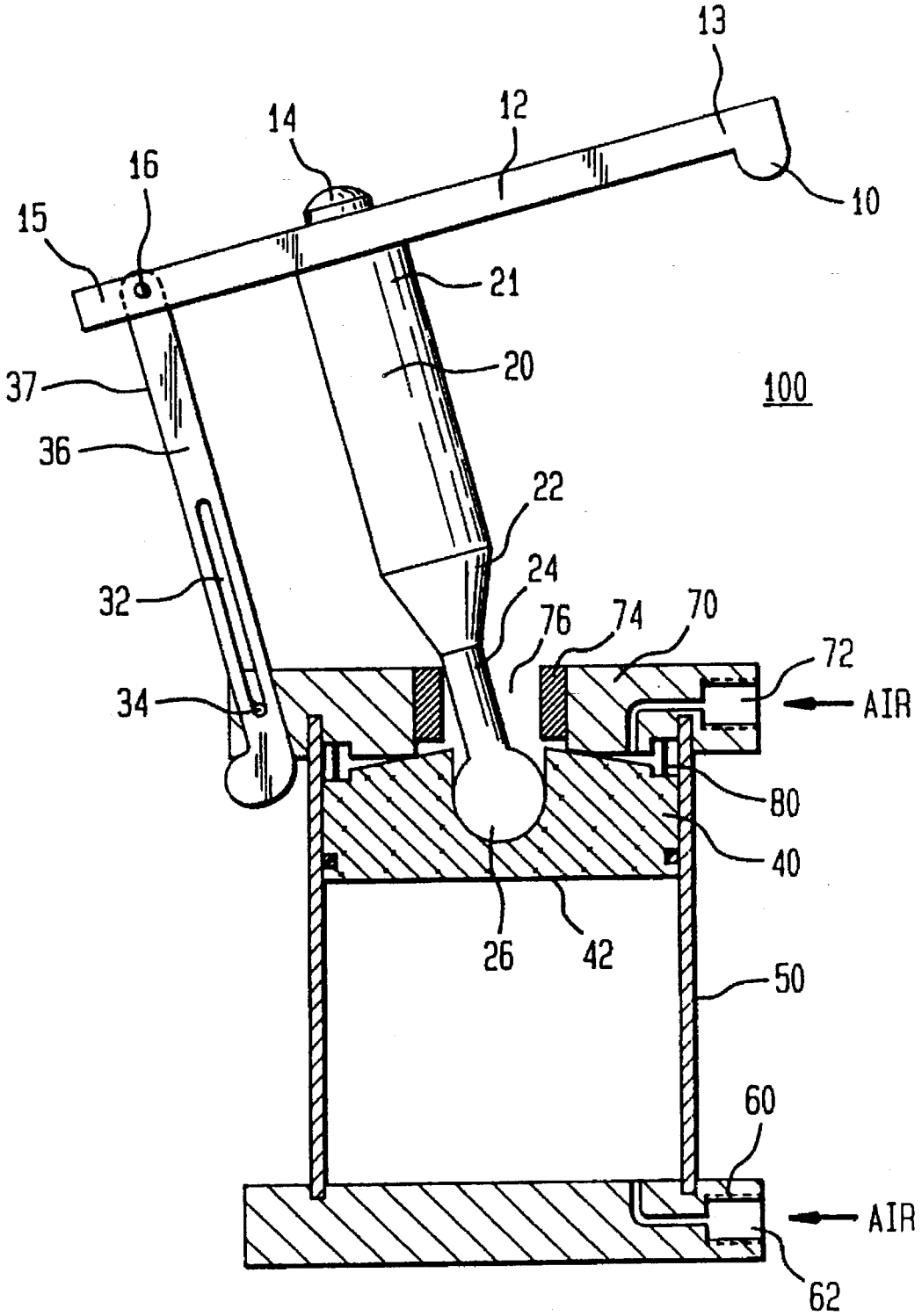
FIG. 1 is a side view of one embodiment of the invention in the unclamped position.

Referring now to FIG. 1, there is shown apparatus 100 in accordance with one embodiment of the invention in an open position. Contact 10 is supported by clamp 12, having first and second ends 13 and 15, respectively, which is mounted to shaft 20 by attachment 14. Pivot 16 is also supported by the clamp on its second end, and it engages a first end 37 of guide 30 through an aperture defined by the guide. The guide also defines a slide 32 along a portion of the guide. Pin 34 is adapted to permit the guide to slide past the pin. Shaft 20 is comprised of four sections: a first section 21, which is connected to the clamp, has a first diameter; a second section is a conical transition section 22 which begins with a first diameter which is equal to the first diameter of the first section, and ends with a second diameter, which is less than the first; a third section 24 which begins at the end of the conical transition section and has a diameter equal to the second diameter; and finally, an end section 26 which is rotatably mounted to piston 40. In this embodiment of the invention, the end is spherical and is adapted to fit within connection means 42 which is a spherical socket defined by the piston. The piston slides within cylinder 50 which is supported on its lower end by base 60, into which a compressed gas may be admitted by inlet 62. The upper end of the cylinder supports housing 70 which defines inlet 72 which is adapted to direct a compressed gas into the cylinder. Annular stop 74 is supported by the housing and has an aperture 76, the inner diameter of which is selected to provide sliding contact to first section 21 of shaft 20. The annular stop is centered over the piston and the degree of tilt away from a vertical axis by shaft 20 when the piston is in the raised position of FIG. 1 is determined by the diameter of third section 24 and the inner diameter of the annular stop 74. The annular stop may be made of a hardened material and may be replaced if it wears, or the annular stop may be an integral part of the housing. Interspersed between housing 70 and piston 40 is compression coil spring 80 which biases the piston away from the housing.

Figure 2:
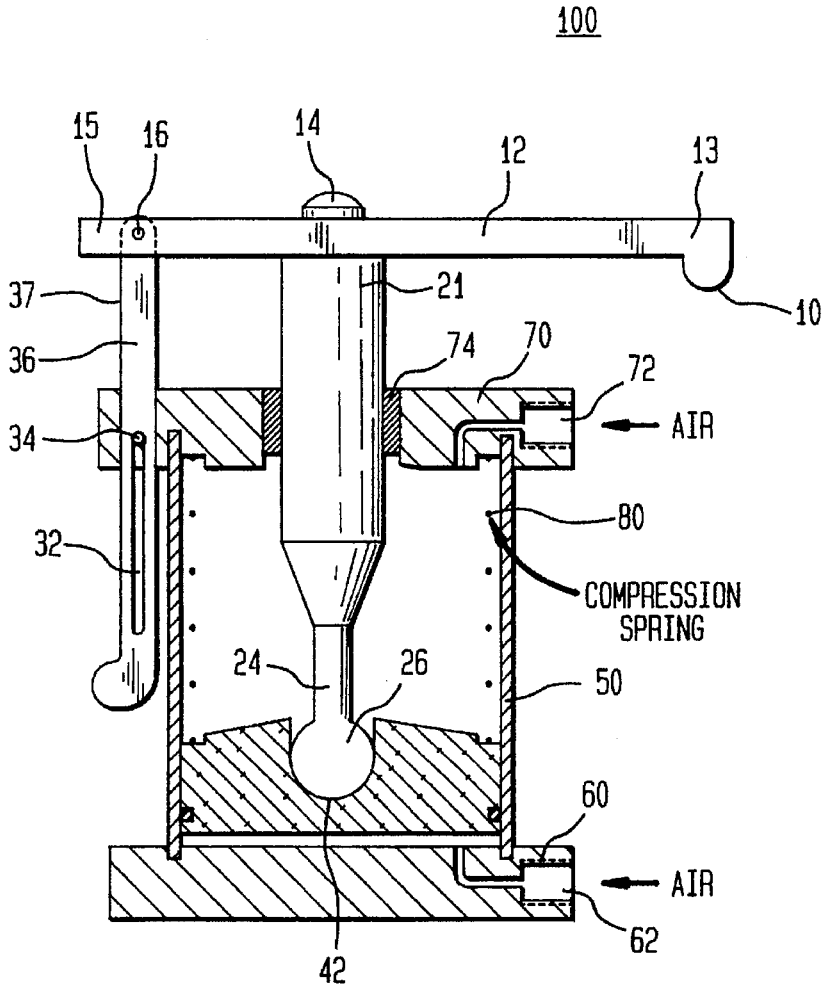
FIG. 2 is a side view of the same embodiment of the invention in the clamped position.

Referring now to FIG. 2, the same elements previously described in FIG. 1 are shown in a closed position of the invention. To reach the closed position, the compressed gas which supported the piston in the open position of FIG. 1 is permitted to escape from inlet 62 by a control valve (not shown) which is well known in the art. Compression spring 80 then forces the piston away from housing 70 causing shaft 20 to rotate clockwise as transition section 22 slides past the upper surface of annular stop 74. At this point shaft 20 is in a vertical position and first section 21 of the shaft is about to enter the annulus defined by annular stop 74. A compressed gas entering through inlet 72 cooperates with the compression spring to drive the piston down to the closed position shown in FIG. 2. It is important to note that in this portion of the stroke the motion of contact 10 is linear and directed downward to contact a workpiece (not shown) without shifting its position. In the closed position slide 32 is at the end of its travel and rests upon pin 34. Guide 30 thus supports clamp 12 at its second end and shaft 20 pulls it down at attachment 14. The force applied to contact 10 is the downward force of the piston diminished by the ratio of the length from attachment 14 to the pivot compared to the total length of the contact. The downward force of the pivot is a function of the pressure of the gas admitted through inlet 72.

When the clamping operation is complete, control valves admit a compressed gas into inlet 62 and permit the gas in the cylinder to escape through inlet 72. Contact 10 moves vertically away from the workpiece until the lower extremity of slide 32 engages pin 34. At this point, transition section 22 is about to protrude above the surface of housing 70. The continued upward movement of the piston and the restraining action of pin 34 upon guide 30 now cause the clamp to rotate counterclockwise in FIG. 1 away from the work area.

Figure 3:
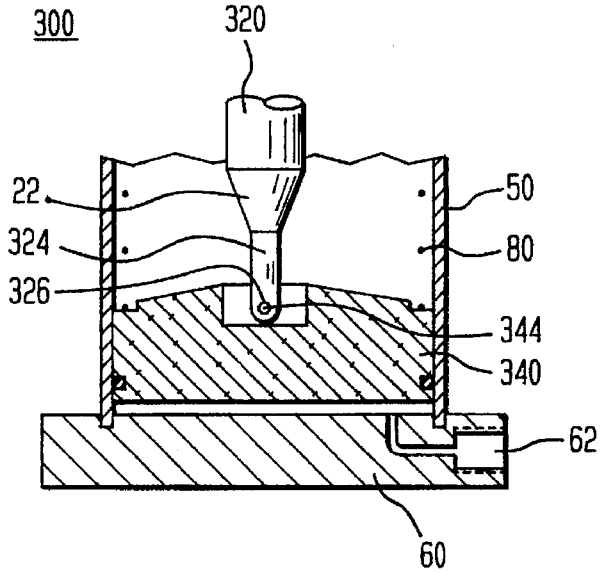
FIG. 3 is a side view of another embodiment of the invention.

Referring now to FIG. 3, there is shown apparatus 300 which is a side view of another embodiment of the invention in which the piston 340 and shaft 320 are secured by connection means 344, a pin in this case. Third section 324 defines aperture 326 which accepts connection means 344. A similar aperture (not shown) on piston 340 accepts connection means 344. Advantages of this structure, compared with the embodiment of FIG. 1, is that the motion of shaft 320 is guided by the pin to rotate in a plane which is perpendicular to the axis of the pin and away from the workpiece. Additionally, use of a pin for attachment rather than a spherical end gives a positive alignment to the piston shaft and apparatus 300 would also be less expensive to manufacture than apparatus 100 which has a spherical connection means. The other elements and their cooperation with each other being the same as described in the discussion regarding FIG. 1 and FIG. 2.

In a preferred embodiment, the invention is used to hold printed wiring boards while electronic components are inserted therein. The piston is very compact, and the stroke of the piston has been as little as 0.5 inches. The length of the stroke depends only upon the needs of the workstation and could be as much as three feet. For the clamping of printed wiring boards, clamp 10 is coated with plastic to prevent marring or scratching of the circuits.

The advantage in each of the embodiments is that the workpiece is contacted by contact 10 with linear motion so that the workpiece is not moved. Yet when the workpiece is released, the contact rises vertically and then rotates away from the work area to permit another workpiece to be installed without interference from the invention. These two motions: rising and turning away, are accomplished with a single cylinder by the cooperation of the slide and the pin, and the interaction of the transition section with the annular stop.

Changes and modifications in the specifically described embodiments can be carried out without departing from the scope of the invention. In particular, the annular stop and the shaft could be made in a rectangular cross section. The annular stop could also incorporate an O-ring to provide an improved seal for the shaft.

I claim:

1. A clamping device which provides access to a work area when in an unclamped position, comprising:

a base;

an open cylinder supported by the base;

a housing, defining an aperture, supported by the cylinder;

a piston, adapted to fit within the cylinder, having a connection means;

a shaft, one end of which is adapted to fit within the connection means;

a clamp, having a first end and a second end, supported by the shaft;

a guide, connected to the second end of the clamp;

a slide, defined by the guide, which extends along a portion of the guide;

a pin, supported by the housing, adapted to fit within the slide thereby restraining the motion of the guide;

a compression spring, adapted to fit within the cylinder, being interspersed between the housing and the piston, thereby biasing the piston away from the housing;

an inlet, defined by the base, adapted to direct a compressed gas into the cylinder;

said shaft further including first section, having a first diameter, being attached to the clamp;

a conical transition section, attached to the first section, having a beginning diameter which is equal to the first diameter of the first section, and a second diameter:

third section, attached to the conical transition section, having a diameter which is equal to the second diameter of the conical transition section: and an end section, attached to the third section, adapted to be rotatably connected to the connection means of the piston.

2. The clamping device of claim 1 further comprising:

a contact supported by the first end of the clamp;

an attachment which connects the clamp to the shaft;

a pivot, mounted on the second end of the clamp, adapted to provide a rotatable connection to the guide; and an inlet, defined by the housing, adapted to direct a compressed gas into the cylinder thereby providing a clamping force which is a function of the pressure of said compressed gas.

3. The clamping device of claim 2 further comprising an annular stop, adapted to fit within the aperture of the housing, having an inner diameter which provides a sliding contact to the first section of the shaft.

4. The clamping device of claim 1 wherein the connection means is a spherical socket.

5. The clamping device of claim 1 wherein the connection means is a pin joining apertures defined by the piston and the shaft.

6. A pneumatic cylinder clamping device for electronic assembly operations which provides access to a work area when in an unclamped position, comprising:

a base;

an open cylinder supported by the base;

a housing, defining an aperture, supported by the cylinder;

a piston, adapted to fit within the cylinder, having a connection means;

a shaft, one end of which is adapted to fit within the connection means of the piston;

a clamp, having a first end and a second end, supported by the shaft;

a guide, connected to the second end of the clamp;

a slide, defined by the guide, which extends along a portion of the guide;

a pin, supported by the housing, adapted to fit within the slide thereby restraining the motion of the guide;

a compression spring, adapted to fit within the cylinder, being interspersed between the housing and the piston, thereby biasing the piston away from the housing;

an inlet, defined by the base, adapted to direct a compressed gas into the cylinder;

said shaft further including a first section, having a first diameter, being attached to the clamp:

a conical transition section, attached to the first section, having a beginning diameter which is equal to the first diameter of the first section, and a second diameter:

a third section, attached to the conical transition section, having a diameter which is equal to the second diameter of the conical transition section; and an end section, attached to the third section, adapted to be rotatably connected to the connection means of the piston.

7. The clamping device of claim 6 further comprising:

a contact supported by the first end of the clamp;

an attachment which connects the clamp to the shaft;

a pivot, mounted on the second end of the clamp, adapted to provide a rotatable connection to the guide; and an inlet, defined by the housing, adapted to direct a compressed gas into the cylinder thereby providing a clamping force which is a function of the pressure of said compressed gas.

8. The clamping device of claim 6 further comprising an annular stop, adapted to fit within the aperture of the housing, having an inner diameter which provides a sliding contact to the first section of the shaft.

9. The clamping device of claim 6 wherein the connection means is a spherical socket.

10. The clamping device of claim 6 wherein the connection means is a pin joining apertures defined by the piston and the shaft.

11. A pneumatic cylinder clamping device for electronic assembly operations which provides access to a work area when in an unclamped position, comprising:

a base;

an open cylinder supported by the base;

a housing, supported by the cylinder, further comprising an annular stop, adapted to fit within an aperture of the housing, having an inner diameter;

a piston, adapted to fit within the cylinder, having a connection means;

a shaft, one end of which is adapted to fit within the connection means of the piston, further comprising a first section, being attached to the clamp and having a first diameter adapted to make a sliding contact with the inner diameter of the annular stop, a conical transition section, attached to the first section, having a beginning diameter which is equal to the first diameter of the first section, and a second diameter, a third section, attached to the conical transition section, having a diameter which is equal to the second diameter of the conical transition section, and an end section, attached to the third section, adapted to be rotatably connected to the piston;

a clamp, having a first end and a second end, supported by the shaft;

a guide, connected to the second end of the clamp;

a slide, defined by the guide, which extends along a portion of the guide;

a pin, supported by the housing, adapted to fit within the slide thereby restraining the motion of the guide;

a compression spring, adapted to fit within the cylinder, being interspersed between the housing and the piston, thereby biasing the piston away from the housing;

an inlet, defined by the base, adapted to direct a compressed gas into the cylinder;

a contact supported by the first end of the clamp;

an attachment which connects the clamp to the shaft;

a pivot, mounted on the second end of the clamp, adapted to provide a rotatable connection to the guide; and an inlet, defined by the housing, adapted to direct a compressed gas into the cylinder thereby providing a clamping force which is a function of the pressure of said compressed gas.

12. The clamping device of claim 11 wherein the connection means is a spherical socket.

13. The clamping device of claim 11 wherein the connection means is a pin joining apertures defined by the piston and the shaft.

* * * * *